US008887412B2

(12) United States Patent
Proeber et al.

(10) Patent No.: US 8,887,412 B2
(45) Date of Patent: Nov. 18, 2014

(54) ROAD POSITION INDICATION FOR MOTOR GRADER SNOW PLOW

(75) Inventors: Brian Christopher Proeber, Dubuque, IA (US); Timoth A. Wilcox, Dallas Center, IA (US); Barry Schaffter, Silvis, IL (US); Michael E. Kennedy, Dubuque, IA (US); Richard J. Erwin, Indianola, IA (US); Nathan Horstman, Durango, IA (US); Robert Meegan, Urbandale, IA (US)

(73) Assignee: Deere & Company, Moline, IL (US)

( * ) Notice: Subject to any disclaimer, the term of this patent is extended or adjusted under 35 U.S.C. 154(b) by 302 days.

(21) Appl. No.: 13/395,365

(22) PCT Filed: Sep. 11, 2009

(86) PCT No.: PCT/US2009/005099

§ 371 (c)(1),
(2), (4) Date: May 23, 2012

(87) PCT Pub. No.: WO2011/031252

PCT Pub. Date: Mar. 17, 2011

(65) Prior Publication Data

US 2012/0246977 A1 Oct. 4, 2012

(51) Int. Cl.

| | |
|---|---|
| ***E01H 5/02*** | (2006.01) |
| ***E02F 9/26*** | (2006.01) |
| ***G08G 1/16*** | (2006.01) |
| ***E02F 9/24*** | (2006.01) |
| ***E02F 3/84*** | (2006.01) |

(52) U.S. Cl.

CPC .. *G08G 1/16* (2013.01); *E02F 9/26* (2013.01); *E02F 9/262* (2013.01); *G08G 1/165* (2013.01); *E02F 9/245* (2013.01); *E02F 3/841* (2013.01)

USPC ..... 37/197

(58) Field of Classification Search

USPC ..... 37/219–236, 348, 196, 241, 197; 172/2–11; 404/113–118

See application file for complete search history.

(56) References Cited

U.S. PATENT DOCUMENTS

| | | | | |
|---|---|---|---|---|
| 6,108,031 | A * | 8/2000 | King et al. | 348/118 |
| 6,772,062 | B2 * | 8/2004 | Lasky et al. | 701/518 |
| 7,072,764 | B2 | 7/2006 | Donath et al. | |
| 8,205,360 | B1 * | 6/2012 | Vanneman et al. | 37/196 |
| 8,467,968 | B1 * | 6/2013 | Dolinar et al. | 701/534 |
| 2009/0041541 | A1 * | 2/2009 | Lowe | 404/14 |
| 2009/0112410 | A1 | 4/2009 | Shull | |

OTHER PUBLICATIONS

International Search Report for Application No. PCT/US2009/05099 (7 pgs.).

Ferlis, R.A. Rowshan, S. and Frye, C. Safe Plowing—Applying Intelligent Vehicle Technology. Public Roads Magazine [online}], Jan. /Feb. 2001, vol. 64, No. 4 [retrieved on Oct. 30, 2009] also at http://www.tfhrc.gov/ubrds/janfeb01/safeplower.htm.

* cited by examiner

*Primary Examiner* — Robert Pezzuto
(74) *Attorney, Agent, or Firm* — Faegre Baker Daniels LLP

(57) ABSTRACT

A motor grader includes a tracking system indicating the location of the motor grader relative to a desired snow plowing path. The tracking system may also indicate the location of prerecorded obstacles along the desired snow plowing path.

21 Claims, 7 Drawing Sheets

ROAD POSITION INDICATION FOR MOTOR GRADER SNOW PLOW

CROSS-REFERENCE TO RELATED APPLICATIONS

This application is a nationalization of PCT Patent Application Serial No. PCT/US2009/005099, filed Sep. 11, 2010, the disclosure of which is expressly incorporated herein by reference.

FIELD OF THE INVENTION

The present disclosure relates to a motor grader, more particularly, the present invention relates to positioning of snow blades on motor graders.

BACKGROUND OF THE INVENTION

During winter, motor graders are sometimes used to remove snow from roads. When used to remove snow, a snow wing having a snow blade is sometimes attached to the motor grader to extend the lateral snow plowing reach of the motor grader. During snow plowing, the operator of the motor grader should watch for obstacles along the road and raise the snow wing and other snow blades attached to the motor grader to avoid striking the obstacles with the snow blades. On occasion, such obstacles may be buried by snow or visibility may otherwise be poor making it difficult for the operator to see the obstacle and raise the snow blade(s) to avoid the obstacle.

SUMMARY

According to one embodiment of the present disclosure, a method of steering a motor grader during reduced visibility conditions is provided including the steps of providing a motor grader including a chassis, a plurality of traction devices positioned to support the chassis and including at least one front traction device and at least one rear traction device, a snow wing extending laterally from the chassis, and a motor grader position indicator indicating the lateral position of the motor grader relative to a desired path; and adjusting the lateral position of the motor grader in response to the indicated lateral position of the motor grader relative to the desired path.

According to another embodiment of the present disclosure, a method of operating a motor grader during reduced visibility conditions is provided including the steps of providing a motor grader including a chassis, a plurality of traction devices positioned to support the chassis and including at least one front traction device and at least one rear traction device, a snow blade supported by the chassis, and an indicator indicating the location of prerecorded obstacles along a path; and adjusting the position of the snow blade relative to the chassis based on the indicated position of the prerecorded obstacle.

BRIEF DESCRIPTION OF THE DRAWINGS

The above-mentioned and other features of this invention, and the manner of attaining them, will become more apparent and the invention itself will be better understood by reference to the following description of embodiments of the invention taken in conjunction with the accompanying drawings, wherein.

Figure 1:
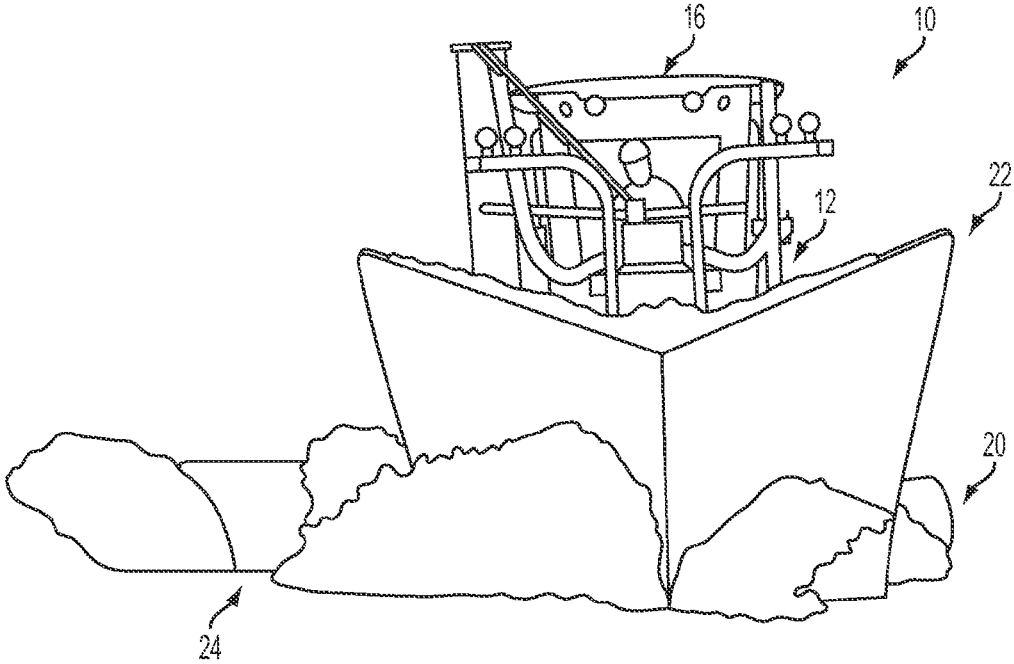
FIG. 1 is a front view of a motor grader showing the motor grader including a chassis, a plurality of wheels supporting the chassis, an operator station, a V plow, and a snow wing that can be raised and lowered.

Corresponding reference characters indicate corresponding parts throughout the several views. Although the drawings represent embodiments of the present invention, the drawings are not necessarily to scale and certain features may be exaggerated in order to better illustrate and explain the present invention.

DETAILED DESCRIPTION

The embodiments disclosed below are not intended to be exhaustive or limit the invention to the precise forms disclosed in the following detailed description. Rather, the embodiments are chosen and described so that others skilled in the art may utilize their teachings.

Figure 2:
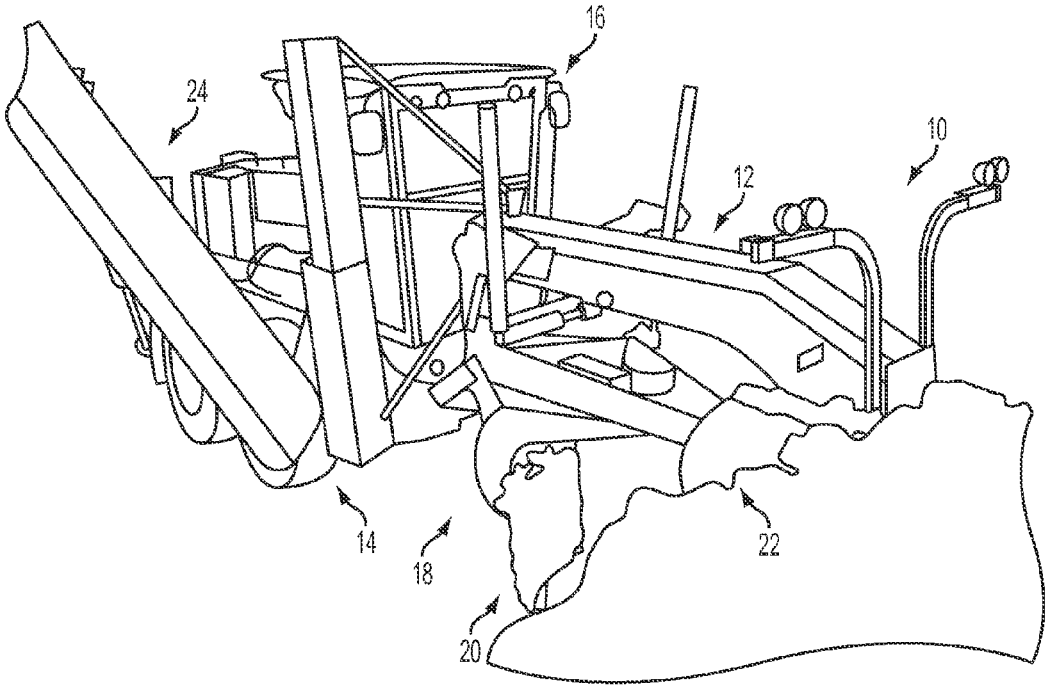
FIG. 2 is another perspective view of the motor grader of FIG. 1 showing the snow wing raised from the lowered position shown in FIG. 1.

In FIG. 1, a vehicle in the form of motor grader 10 is provided. Although the vehicle is illustrated and described herein as motor grader 10, the vehicle may include any other type of vehicle including, for example, a bulldozer, truck, or other vehicle. Motor grader 10 includes chassis 12 and ground engaging mechanisms 14. Ground engaging mechanisms 14 may include any device capable of supporting and/or propelling chassis 12. For example, as illustrated in FIG. 2, ground engaging mechanisms 14 may include wheels. Motor grader 10 further includes operator station 16 supported by chassis 12 for an operator of motor grader 10.

Referring to FIGS. 1 and 2, motor grader 10 further includes moldboard assembly 18. Moldboard assembly 18 includes grader blade 20 for pushing, spreading, and leveling soil and other material, such as snow. Additional details of a suitable motor grader 10 are provided in U.S. patent application Ser. No. 12/257,839 to Harber et al., filed Oct. 24, 2008, titled "Arrangement of Steering Wheel and Operator Seat Assembly," the entire disclosure of which is expressly incorporated by reference herein.

During winter, motor grader 10 may also be provided with a V plow 22 and a snow wing 24 to plow snow off of a road as shown in FIG. 1. Grader blade 20, V plow 22, and snow wing 24 may be lowered to plow snow, as shown in FIG. 1, or raised when not in use or to avoid obstacles along or on the road, such as mail boxes, manhole covers, curbs, etc. For example in FIG. 2, snow wing 24 is raised while not in use or to avoid an obstacle along the road.

If the snow fall is heavy enough and/or visibility is otherwise low, obstacles along the road may be difficult for an operator to see because they are buried or not readily visible. Motor grader 10 is provided with a tracking system 26 that tracks the location of motor grader 10 along a desired snow plow track 66 to assist the operator in determine whether motor grader 10 is following the desired snow plow track. Tracking system 26 may also track the location of obstacles 33 relative to the desired snow plow track 66, motor grader 10, or otherwise, to inform the operator of the location of an obstacle 33, even if it is difficult for the operator to see obstacle 33 through operator station 16.

Figure 3:
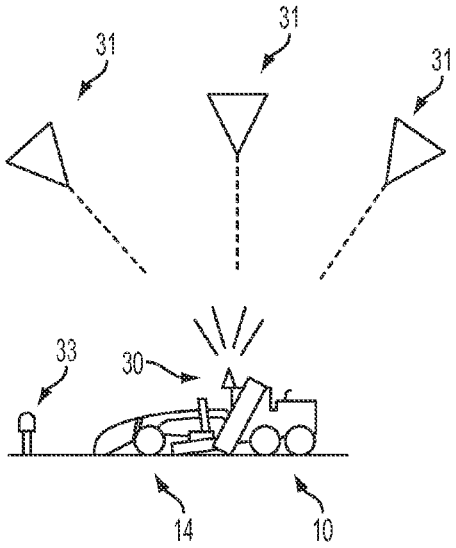
FIG. 3 is a view of the motor grader showing the motor grader of FIG. 1 supporting a GPS unit in communication with GPS satellites to determine the location of the GPS unit and the motor grader.
Figure 4:
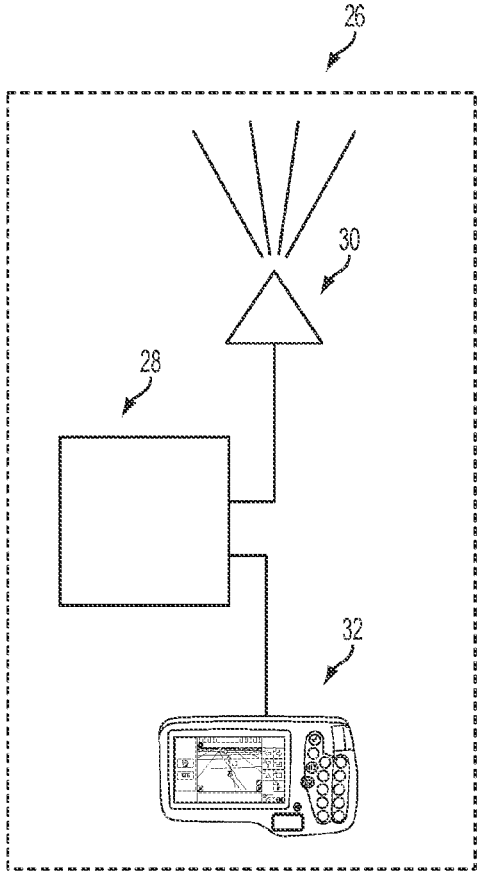
FIG. 4 is a schematic view of a tracking system including the GPS unit, memory, and a tracking monitor used to track the location of the motor grader.
Figure 5:
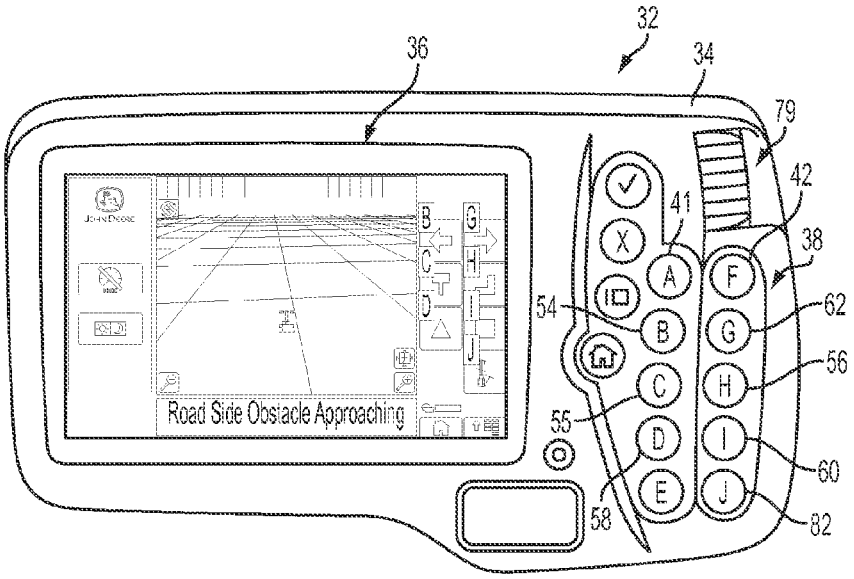
FIG. 5 is a front view of the monitor of the motor grader of FIG. 1 showing the monitor including a housing, a plurality of input buttons, and a viewing screen.

According to the exemplary embodiment of the present disclosure, tracking system 26 includes memory 28 that stores a desired snow plow track, the location of obstacles 33 along the desired snow plow track 66, and/or the type of obstacle as shown in FIG. 4. System 26 includes at least one GPS unit 30 that is in communication with GPS satellites 31 to determine the location of the GPS unit 30 or any object associated therewith, such as motor grader 10 and/or obstacles 33 along the road as shown in FIG. 3. As shown in FIG. 5, tracking system 26 further includes monitor 32 positioned within operator station 16 having housing 34, display screen 36, and input buttons 38.

Initially, display screen 36 displays a menu screen 40 listing a guidance mode selection and a track creation mode selection. To select the guidance mode, the operator pushes A button 41 to display a guide screen showing a desired path 66 and obstacles 70, 72, 74, 76, as described in greater detail below. To select the track creation mode, the operator pushes F button 42 to display a tracking screen allowing an operator to map the road and tag obstacles.

During track creation mode, motor grader 10 equipped with GPS unit 30 is driven down a road or other path that may need to be cleared of snow at a future date. Other vehicles, such as cars, trucks, etc., may also be equipped with GPS unit 30 during the track creation mode. The operator of motor grader 10 (or other vehicle) attempts to steer the vehicle along a desired path, such as the center of the road. As motor grader 10 moves down the road, GPS unit 30 communicates its location to memory 28 constantly or at a periodic or other basis so memory 28 stores the track or path 66 that motor grader 10 follows. Because motor grader 10 is following the road, memory 28 has tracked or mapped the path of the road. The stored track 66 will later be used by tracking system 26 to assist the motor grader operator in directing motor grader 10 over the same road that may be covered in snow or otherwise difficult to see.

While the operator is tracking the road, they also mark the location of objects 33 that may create obstacles for motor grader 10 during snow plowing in the future. As the operator steers motor grader 10 (or the other tracking vehicle), the operator observes objects 33 on or along the road. When the operator identifies an object 33 that may present a future obstacle during snow plowing, they tag object 33 using tracking system 26 so that memory 28 records the location of object 33 along the path for future use during snow plowing.

Figure 7:
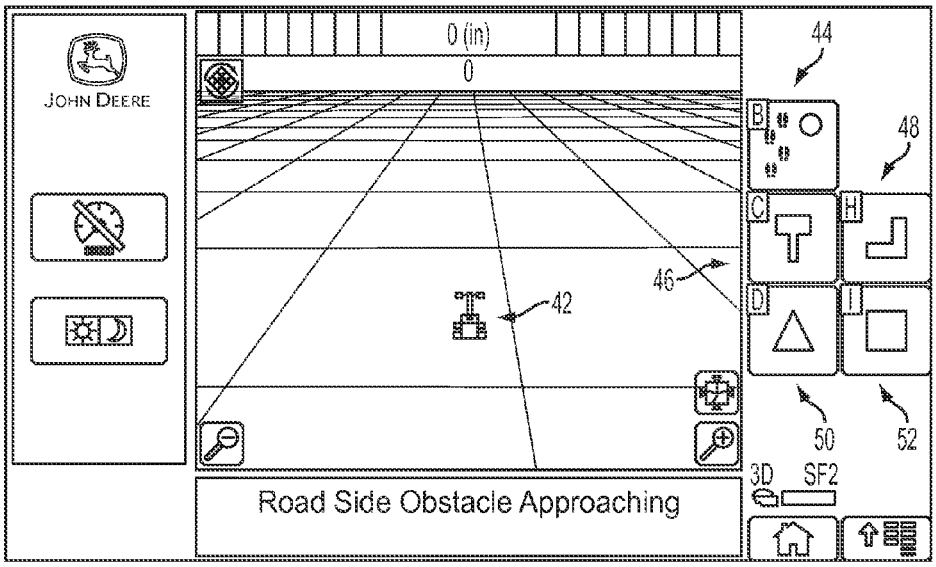
FIG. 7 is a preliminary track creation screen showing a graphical representation of the motor grader before a track and obstacles are recorded.
Figure 8:
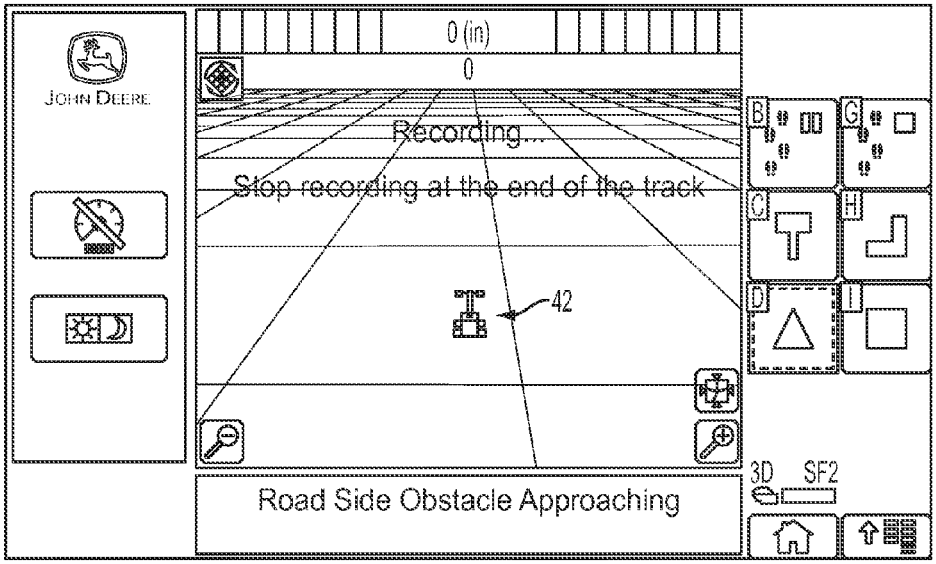
FIG. 8 is an active track creation screen showing the graphical representation of the motor grader while the operator steers the motor grader along a future snow plow track and records the location of obstacles along the future snow plow track.

As shown in FIG. 7, a graphical system of a motor grader 42 is shown along with a start recording symbol 44, roadside high obstacle symbol 46, roadside low obstacle symbol 48, center of road obstacle symbol 50, and an other obstacle symbol 52. Each symbol 44, 46, 48, 50, 52 includes a reference letter (ex. B, C, H, D, I, respectively). To start mapping and flagging obstacles, the operator presses B button 54 (shown in FIG. 5), which causes tracking system 26 to start tracking the path driven by the operator and switches display screen 36 to the recording screen shown in FIG. 8, which indicates that the path and obstacles are being recorded by tracking system 26.

As described above, while tracking system 26 is in the tracking mode, it records the path of motor grader 10 to map the road. As motor grader 10 travels down the road, the operator observes objects 33 that may be obstacles to motor grader 10 during snow plowing. During this observation, the operator categorizes obstacles 33 into one of several types. When motor grader 10 reaches a particular location relative to the obstacle, the operator flags the obstacle by selecting a button 38 corresponding to one of symbols 46, 48, 50, 52 discussed above. For example, when an operator observes an object along the road that is relatively tall, such as a mail box, and front wheel 14 of motor grader 10 aligns laterally with the mail box, the operator presses C button 55 (that corresponds to a "roadside high obstacle") to flag the location of the mail box and its location along recorded track 66. Memory 28 of tracking system 26 records the location of the roadside high obstacle along path 66 it is recording. By knowing the predetermined location of GPS unit 30 relative to front wheel 14, tracking system 26 can determine the location of obstacle 33 along recorded track 66. For example, if GPS unit 30 is located 15 feet (4.57 m) behind front wheel 14 on motor grader 10, tracking system 26 will record that the obstacle is 15 feet (4.57 m) forward of the location of GPS unit 30 at the time the operator pushes B button 54.

As the operator continues to track the path of the road, they continue to observe, flag, and categorize other obstacles. In addition to flagging "roadside high obstacles," the operator can flag "roadside low obstacles," such as curbs, by pressing H button 56; "center of road obstacles," such as manhole covers, by pressing D button 58; or "other obstacles" by pressing I button 60. "Other obstacles" is a catchall category for obstacles that may or may not fall into the roadside high, roadside low, or center of the road categories. For example, overhead obstacles, such as bridge overpasses, could be flagged as an "other" obstacle.

Figure 6:
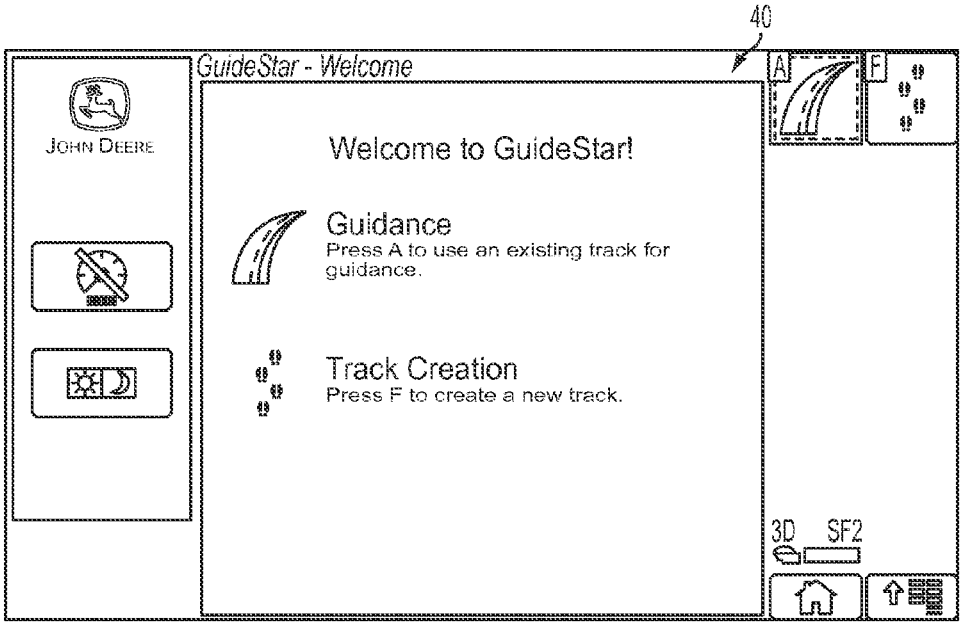
FIG. 6 is a welcome screen displayable on the viewing screen of the monitor of FIG. 3.

If the operator needs to pause the tracking, they can press B button 54 to pause tracking. Similarly, if the operator reaches the end of the track being recorded, they can press G button 62 to indicate that motor grader 10 has reached the end of the path. After track and obstacle recording is stopped, screen 36 returns to the menu screen 40 shown in FIG. 6. According to alternative embodiments of the present disclosure, buttons 38 may be on display screen 36 such that display screen 36 is a touch screen that can receive inputs.

At a later date when motor grader 10 is being used for plowing snow, the operator can use the previously recorded track and obstacle locations to navigate a snow covered road and avoid snow covered obstacles 33 that were previously recorded. To navigate using tracking system 26 during snow plowing, the operator selects the guidance mode by pressing A button 41, which causes display 36 to show guidance screen 64, shown in FIG. 9.

Guidance screen 64 shows previously recorded path 66 of the road stored in memory 28 and the current, actual path 68 of motor grader 10 as detected by GPS unit 30 mounted on motor grader 10. As discussed above, tracking system 26 previously recorded the location of obstacles 33 observed and flagged by an operator along path 66. Guidance system 64 displays the location of the previously recorded obstacles 33 relative to motor grader 10 and paths 66, 68.

Figure 9:
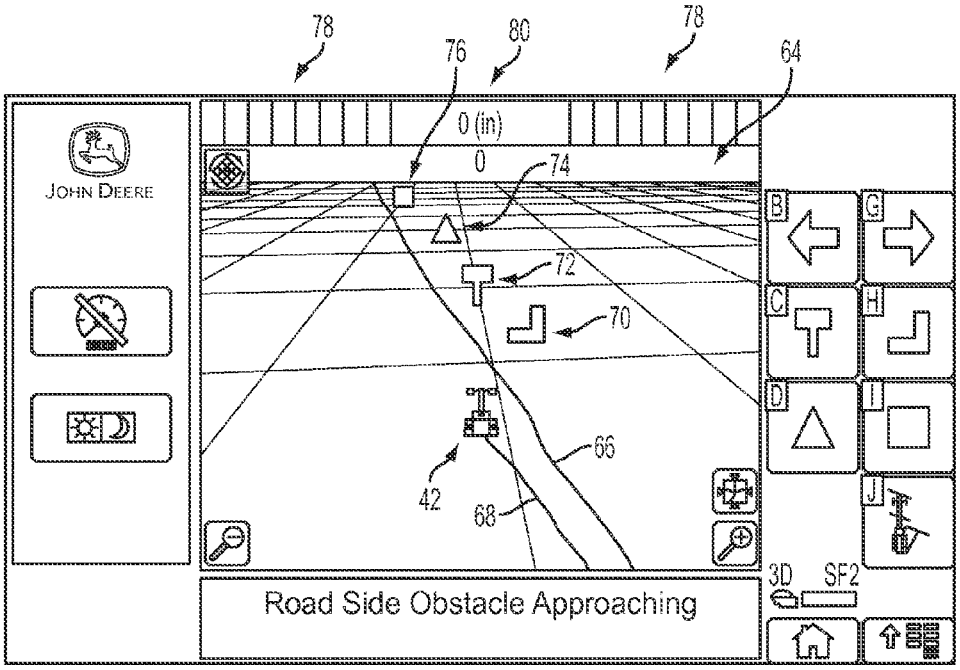
FIG. 9 is a guidance screen showing graphical representations of obstacles that were prerecorded along the snow plow track recorded during track creation.
Figure 10:
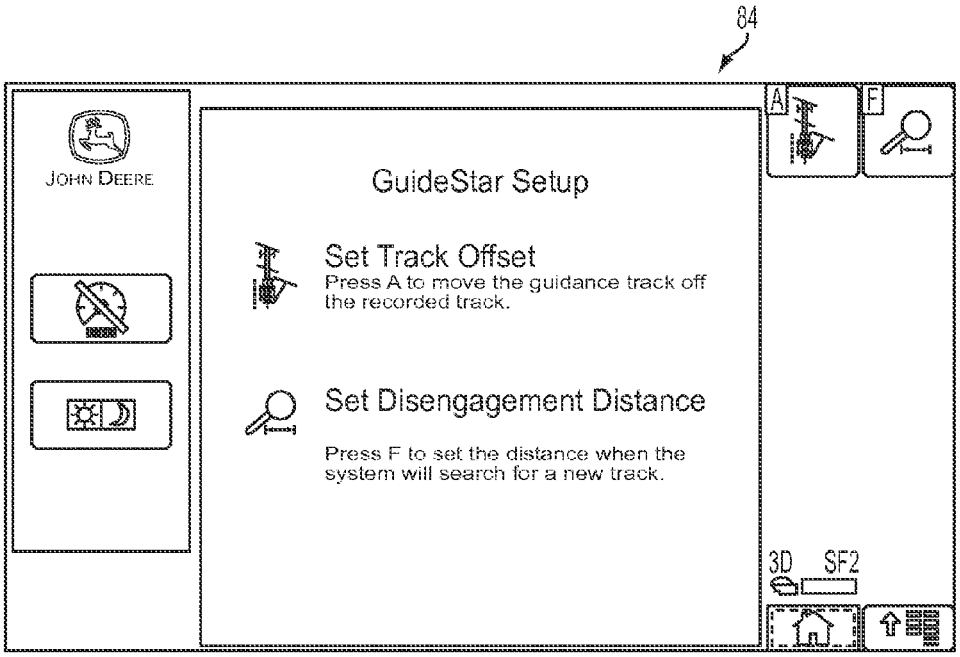
FIG. 10 shows a setup screen.

As shown in FIG. 9, screen 64 is displaying four recorded obstacles 70, 72, 74, 76 along recorded path 66. First recorded obstacle 70 is a roadside low obstacle; second recorded obstacle 72 is a roadside high obstacle; third recorded obstacle 74 is a center of road obstacle; and fourth recorded obstacle 76 is an "other" obstacle.

As motor grader 10 travels further along recorded path 66, recorded obstacles 70, 72, 74, 76 get closer to motor grader symbol 42 so the operator can anticipate when motor grader 10 approaches the actual prerecorded obstacle 33. In addition to the graphical warning provided by recorded obstacle symbols 70, 72, 74, 76, tracking system 26 provides an audible alarm. When motor grader 10 is within a predetermined distance of the recorded location of an obstacle, tracking system 26 provides an audible signal in operator station 16. The audible signal may be the same for each type of obstacle (roadside high, roadside low, center of road, or other) or the signal may be different for each type of obstacle (ex. one beep for roadside high, two beeps for roadside low, etc.).

Eventually recorded obstacles 70, 72, 74, 76 will reach motor grader 42 on screen 36. As each recorded obstacle 33 approaches, the operator raises (or lowers) the appropriate blade 20, 22, 24 on motor grader 10 to avoid striking obstacle 33. For example, when front tire 14 of motor grader 42 reaches roadside low obstacle 70, the operator slightly raises snow wing 24 to avoid the roadside low obstacle, such as a curb. According to an alternative embodiment for long obstacles, such as curbs, the operator can flag start point of the obstacle by pressing one of buttons 38 and the end point of the obstacle by pressing one of buttons 38. A line (not shown) can be shown on display 36 extending from the start point to the end point to illustrate the long obstacle. According to another alternative embodiment for obstacles have a unique shape, the operator can flag the geometry of the obstacle by pressing buttons 38 to provide the outline of the obstacle.

After passing obstacle 70, the operator lowers snow wing 24 to its normal level. When front tire 14 of motor grader 42 reaches roadside high obstacle 72, the operator raises snow wing 24 higher to avoid the roadside high obstacle 33, such as a mail box. When front tire 14 of motor grader 42 approaches center of road obstacle 74, the operator raises V plow 22 and/or grader plow 20 to avoid striking the center of road obstacle, such as a manhole cover. Before front tire 14 of motor grader 42 reaches other obstacle 76, the operator should look around for obstacles, such as bridge overpasses, and move snow wing 24, V plow 22, and grader blade 20 accordingly to avoid striking the prerecorded obstacle. For example, when the operator receives the audible warning that an "other" object is approaching, they may notice that a bridge overpass is approaching. If snow wing 24 is raised, the operator should lower snow wing 24 to avoid striking the overpass. As the operator guides motor grader 10 using the guidance mode, the operator can record additional obstacles 33 they observe along the road. For example, if the operator observes a new mail box 33, they can press C button 55 indicating a new roadside high obstacle is located along recorded path 66.

Because tracking system 26 provides a visual or other indication to the driver of prerecorded obstacles, the operator can avoid the prerecorded obstacles 33 even when the prerecorded obstacles 33 are buried in snow and/visibility is poor. In addition to allowing the operator to avoid obstacles 33, tracking system 26 may also be used to help the operator guide motor grader 10 along the road being plowed. As with obstacles 33 buried by snow or otherwise difficult to see, the road being plowed may be difficult to see and it may be difficult to keep motor grader 10 plowing the desired portions of road.

Because tracking system 26 knows the tracked route 66 of the road and the current location of motor grader 10, it can tell the operator if motor grader 10 is correctly following the road. As shown in FIG. 9, screen 36 includes a series of bars or rectangular boxes 78 on each side of offset indicator 80. Offset indicator 80 provides a dimensional indication of the amount of offset of motor grader 10 from desired route 66. Bars 78 light up depending upon how far off course motor grader 10 is to tracked path 66. For example, if each bar 78 represents being off of tracked path 66 by one foot (0.30 m), four bars 78 would light up to the left of offset indicator 80 when motor grader is four feet (1.22 m) to the left of tracked path 66. If motor grader 10 was six feet (1.83 m) to the left of tracked path 66, six bars 78 to the left of offset indicator 80 would light up. When the operator observes a one or more bars 78 lighting up, they can steering motor grader 10 in the appropriate direction toward desired path 66.

Figure 12:
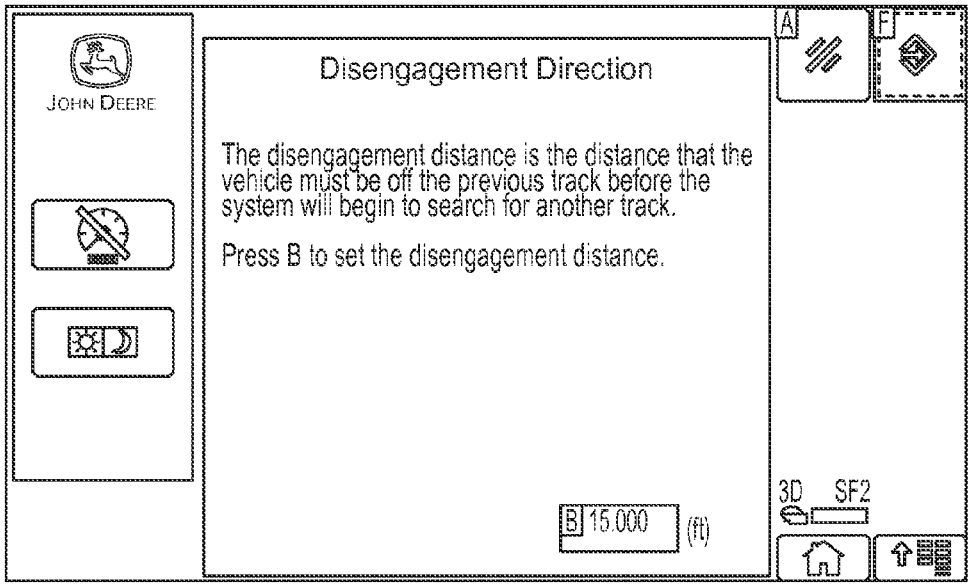
FIG. 12 shows a disengagement screen.

The value of each bar 78 can be adjusted by pressing J button 82 so that screen 36 displays guide setup screen 84 shown in FIG. 9. To set the value of bars 78, the operator presses F button 42 so that screen 36 displays the screen shown in FIG. 12. The operator enters the value of the total side-to-side distance covered by bars 78. The value can be entered by calling up a virtual keypad with indicators corresponding to respective buttons 38 or scroll wheel 79 can be used. For example, in FIG. 12, 15 feet (4.57 m) is entered so that each of the sixteen bars 78 represents slightly less than one foot (0.30 m).

Tracking system 26 allows the operator to follow paths parallel to prerecorded tracks. For example, if recorded track 66 was recorded along the center of a two lane road, the operator may want to plow only the left-hand lane. As a result, it would be beneficial if the measured offset indicated by bars 78 could be offset by a desired amount. To make such an offset, the operator presses A button 41 so that track offset screen 86 is displayed. The operator then enters the offset distance, shown as 3 feet (0.91 m) in FIG. 11. To offset the desired path to the opposite side of the road, the operator presses G button 62.

After an offset adjustment is made, screen 36 returns to guidance screen shown in FIG. 9. The amount of offset shown by bars 78 is then shifted to the left or right by the amount entered on offset screen 86. For example, if the offset is to the right by 3 feet (0.91 m), no bars will light up if motor grader 10 is three feet (0.91 m) to the right of tracked path 66. When motor grader is two feet (0.61 m) to the left of tracked patch 66, a single bar 78 on the left of indicator 80 will light up indicating that motor grader 10 is a foot (0.30 m) off of the desired path.

Figure 11:
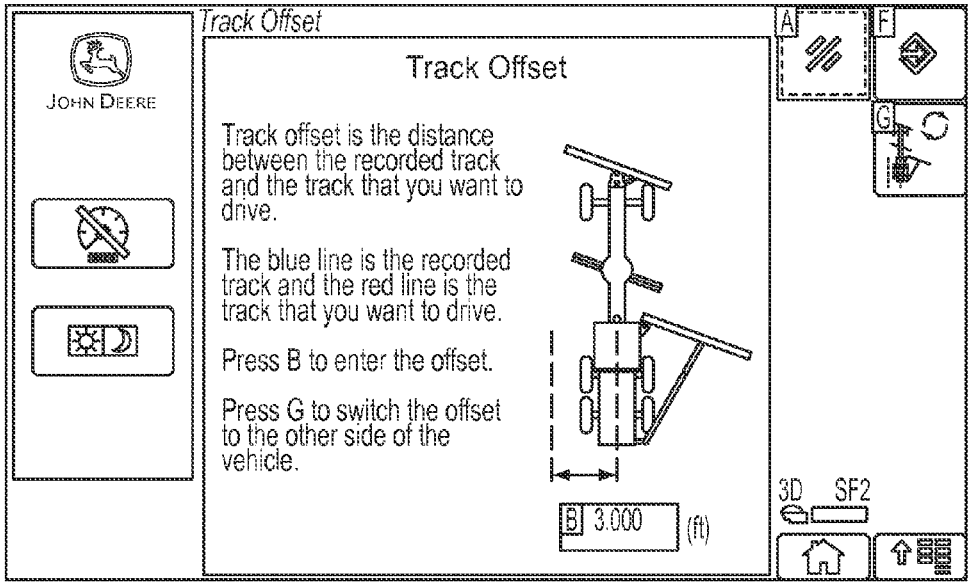
FIG. 11 shows a track offset screen.

In addition to adjusting the offset on offset screen 86, the operator can adjust the offset on guidance screen 64 shown in FIG. 9. To offset the desired path to the left, the operator presses B button 54. To offset the desired path to the right, the operator presses G button 62. Typically, these buttons 54, 62 are used to make smaller adjustments (ex. 3 inches (7.62 cm) at a time) and the offset screen of FIG. 11 is used to make larger adjustments.

According to an alternative embodiment of the present disclosure, screen 36 will display additional geographic features. For example, according to one embodiment, screen 36 will show roads that intersect the tracked path. Tracking system 26 could also track which roads have been plowed. As a result, a central operator coordinating the efforts of multiple snow plowing vehicles, such as motor grader 10, can monitor the progress of which roads have been plowed and which roads remain to be plowed or need to be plowed again as the result of additional snow fall or drifting.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A method of steering a motor grader during reduced visibility conditions, the motor grader including a chassis, a plurality of fraction devices positioned to support the chassis and including at least one front traction device and at least one rear traction device, and a snow wing extending laterally from the chassis, the method including the steps of:

receiving, by a tracking system, a lateral offset corresponding to a prerecorded path;

determining, by the tracking system, a desired path based on the prerecorded path and the lateral offset;

providing, with a motor grader position indicator of the tracking system, an indication of the lateral position of the motor grader relative to the desired path; and adjusting the lateral position of the motor grader in response to the indication of the lateral position of the motor grader relative to the desired path.

2. The method of claim 1, wherein the motor grader position indicator indicates that the motor grader is right or left of the desired path.

3. The method of claim 1, wherein the motor grader position indicator indicates the lateral distance between the motor grader and the desired path.

4. The method of claim 1, wherein the lateral offset is received by the tracking system based on at least one operator input to the tracking system.

5. The method of claim 1, wherein the desired path is based on a path recorded by a motor grader.

6. The method of claim 1, further comprising the step of adjusting the sensitivity of the indicator from within an operator's station of the motor grader.

7. The method of claim 1, further comprising the step of adjusting the position of the snow wing based on a prerecorded position of an obstacle indicated by the indicator.

8. The method of claim 1, wherein the lateral offset identifies a lateral distance from the prerecorded path.

9. A method of operating a motor grader during reduced visibility conditions, the motor grader including a chassis, a plurality of fraction devices positioned to support the chassis and including at least one front traction device and at least one rear traction device, and a snow blade supported by the chassis, the method including the steps of:

providing, with an indicator, an indication of the location of prerecorded obstacles along a path; and adjusting the position of the snow blade relative to the chassis during a snowplowing operation based on the indicated position of the prerecorded obstacle.

10. The method of claim 9, wherein the indicator indicates the type of obstacle.

11. The method of claim 10, wherein the amount of adjustment of the position snow blade relative to the chassis is based on the type of obstacle.

12. The method of claim 9, wherein the indicator provides an indication of the height of the prerecorded obstacle.

13. The method of claim 12, wherein the indication of the height is based on a grouping of the obstacle's height.

14. The method of claim 10, wherein the amount of adjustment of the snow blade relative to the chassis is based on the indication of the height.

15. The method of claim 9, wherein the snow blade is raised over the obstacle corresponding to the prerecorded obstacle as a result of the snow blade position adjustment step.

16. The method of claim 9, wherein the view from an operator's station of the motor grader of an obstacle corresponding to the prerecorded obstacle is obscured during the snow blade position adjustment step.

17. The method of claim 16, wherein the obstacle corresponding to the prerecorded obstacle is obscured by snow.

18. The method of claim 9, wherein an obstacle corresponding to the prerecorded obstacle is a mailbox.

19. The method of claim 9, wherein an obstacle corresponding to the prerecorded obstacle is a curb.

20. The method of claim 10, wherein the amount of adjustment of the snow blade relative to the chassis is based on the indication of the height.

21. The method of claim 10, wherein the motor grader includes multiple snow blades and selection of which snow blade to adjust the position of relative to the chassis is based on the type of obstacle.

* * * * *

UNITED STATES PATENT AND TRADEMARK OFFICE

CERTIFICATE OF CORRECTION

PATENT NO. : 8,887,412 B2
APPLICATION NO. : 13/395365
DATED : November 18, 2014
INVENTOR(S) : Proeber et al.

It is certified that error appears in the above-identified patent and that said Letters Patent is hereby corrected as shown below:

In the Claims

Column 7, Claim 1, Line 16, change [fraction] to traction

Column 8, Claim 9, Line 5, change [fraction] to traction

Signed and Sealed this
Third Day of March, 2015

Michelle K. Lee

Michelle K. Lee
*Deputy Director of the United States Patent and Trademark Office*